US006131357A

United States Patent [19]

Martin-Lunas Sourdeau

[11] Patent Number: 6,131,357

[45] Date of Patent: Oct. 17, 2000

[54] MODULAR ARTICULATED BEAM WITH VARIABLE GEOMETRY AND LENGTH

[76] Inventor: Alejandro Martin-Lunas Sourdeau, Professor Waskman, 5, 28036 Madrid, Spain

[21] Appl. No.: 09/417,860

[22] Filed: Oct. 14, 1999

[30] Foreign Application Priority Data

Dec. 3, 1998 [ES] Spain ..... 9802539

[51] Int. Cl.[7] ..... E04C 3/02

[52] U.S. Cl. ..... 52/694; 14/14; 14/4

[58] Field of Search ..... 52/108, 641, 693, 52/694; 14/3, 4, 5, 6, 7, 9, 13, 14, 78

[56] References Cited

U.S. PATENT DOCUMENTS 2,844,232 7/1958 LeRoy ..... 52/108
4,259,825 4/1981 Hedgepeth ..... 52/645
5,826,384 10/1998 O'Neill ..... 52/645
5,964,068 10/1999 O'Neill ..... 52/645

FOREIGN PATENT DOCUMENTS 98440 4/1964 Denmark ..... 14/4
1 091 594 10/1960 Germany ..... 14/14

*Primary Examiner*—Carl D. Friedman
*Assistant Examiner*—Kevin McDermott
*Attorney, Agent, or Firm*—Ostrolenk, Faber, Gerb & Soffen, LLP

[57] ABSTRACT

An articulated modular beam formed by a plurality of rigid modules designed to withstand compression on a planar surface, and a bendable coupling piece connecting the modules on one side such that the distance between one side of the modules can be varied so as to achieve a desired shape or curve.

39 Claims, 5 Drawing Sheets

FIG. 6B
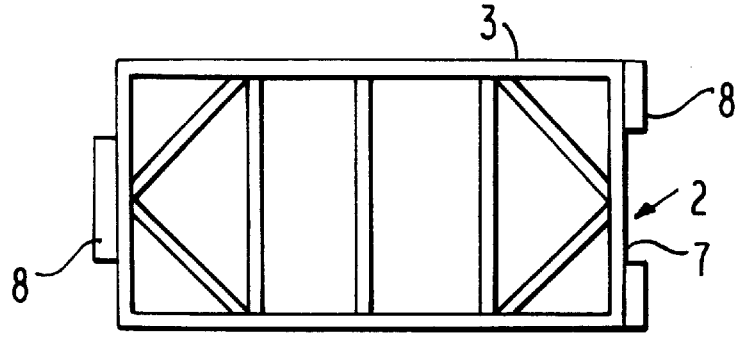
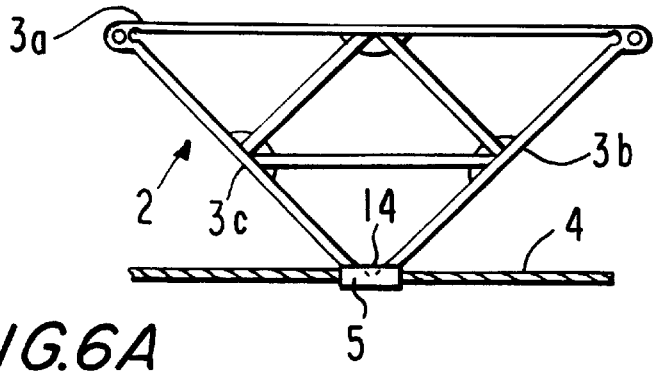
FIG. 6A
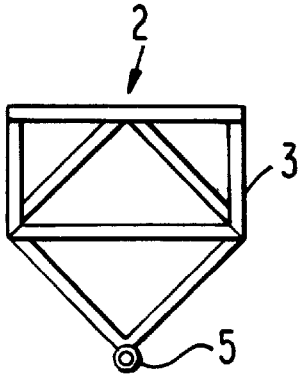
FIG. 6C
FIG. 7A
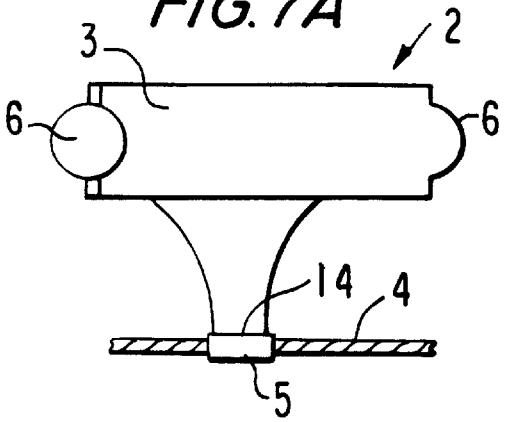
FIG. 7C
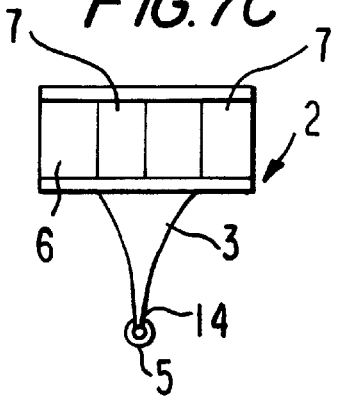
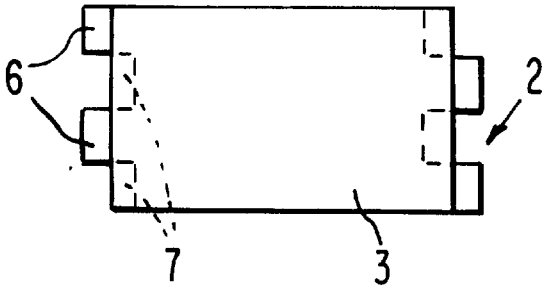
FIG. 7B

MODULAR ARTICULATED BEAM WITH VARIABLE GEOMETRY AND LENGTH

BACKGROUND OF THE INVENTION

1. Field of the Invention

The present invention relates to a modular articulated beam which has a variable shape and length.

2. Description of the Related Art

A variety of beam types exist in the prior art, e.g., rectangular beams, circular beams, or flanged beams, (i.e. I-beams, C-beams, L-beams). The shape and length of the beams depend on the particular use or function of the beam and must be customized to the application site where the beam will be installed.

Because of the variety of shapes and application sites, beams must presently be manufactured in a variety of sizes and lengths. Furthermore, for beams that are curved, different portions of the beams must be manufactured separately because each piece will differ in length. This increases the cost of manufacture.

After manufacture, the beams are transported in their final form to the site where they will be used. This, however, is also inefficient and costly due to the rigidity and shape of the beams. The production and transport of beams would be greatly economized if they were provided with sufficient flexibility for variable shaping and compact storage and transport, without compromising the rigidity and strength of the beams. None of the beams presently known in the art possess these characteristics for such adaptability.

SUMMARY OF THE INVENTION

The present invention provides a modular articulated beam which is variable in length, conducive to being formed in a multitude of shapes and allows for compact storage and transport, all while still maintaining rigidity and strength of the beam.

To provide these features, a beam of the present invention comprises a plurality of modules, each module including first, second and third points which are fixed in space relative to one another. Each of the modules is coupled to an adjacent module to form a pair of modules. The first point of one module of the pair is hingedly coupled to the second point of the other module of the pair along a respective axis such that the third points of the pair of modules can be moved relative to one another only along a fixed plane which is perpendicular to said axis. An elongated, bendable coupling member is fixedly coupled to each of said third points so as to define a maximum distance that each respective pair of third points can be moved apart from one another.

The present invention is also directed towards a kit, comprising a plurality of modules, each module including first, second and third points which are fixed in space relative to one another. Each of the modules has integral hinge components which extend through the first and second points, respectively. A plurality of further hinge components cooperate with the integral hinge components to permit respective pairs of modules to be hingedly coupled to one another along a respective axis which is unique to each such pair. The third points of the pair of modules can be moved relative to one another only along a fixed plane which is perpendicular to said axis. The kit also comprises an elongated, bendable coupling member and a plurality of fixing members for fixing each third point to a respective location along the coupling member.

Ease of transport, speed of assembly, and ready adaptability to a desired shape render the beam of the present invention particularly suitable for a variety of applications, including the following:

- Construction of stands in fairs and exhibitions;
- Creation of attractive designs for summer or temporary awnings;
- Building of safety frames or other support structures in tunnels to protect workers during the construction of those tunnels or in cases of emergency;
- Creating framework in a variety of shapes;
- Military use, such as where any type of rapid construction is required, for setting up structures which conform to terrain contours and/or in areas where access is difficult (hangars, bridges, camouflages, etc.).

Use of the beam in the construction of large hangars allows the hangar to be perfectly contoured to the topography of the land. If appropriately covered with camouflage canvas, hangars which are constructed in this manner will blend into the landscape.

During the construction of tunnels in the building of a subway, railway, road, etc. and also in mining, it is necessary to ensure the safety of the workers by efficiently reinforcing new sections as work advances are made. The use of traditional vertical beams is unsuitable for this application because vertical beams create obstructions which interfere with the ongoing construction work.

The beam of the present invention can also be used in forming various frameworks where traditional vertical pillars are inappropriate, such as in building bridges or at sites where it is important not to block traffic flow. Moreover, the beam facilitates the creation of frames having special or artistic shapes.

Other objects, features and advantages of the present invention will become apparent from the following description of the invention which refers to the accompanying drawings.

BRIEF DESCRIPTION OF THE DRAWINGS

For the purposes of illustrating the invention, there is shown in the drawings, several forms which are presently preferred, it being understood, however, that the invention is not limited to the precise arrangements and instrumentalities shown.

FIGS. 6A–6C show the front, top, and side views, respectively, of a module of the beam of FIG. 1.

FIGS. 7A–7C show the front, top, and side views, respectively, of an alternative embodiment of a module.

DETAILED DESCRIPTION OF THE PREFERRED EMBODIMENTS

Figure 1:
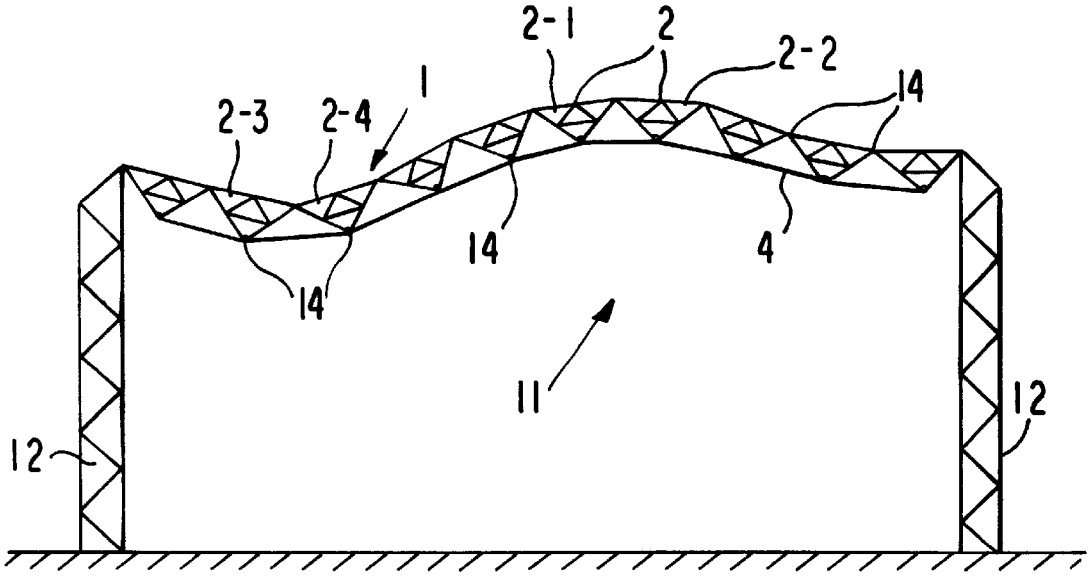
FIG. 1 shows a front view of an articulated modular beam, used as a portal, showing an embodiment of the present invention.

The preferred embodiment of the present invention is now described referring to the drawings, wherein like numerals indicate like elements.

Figure 2:
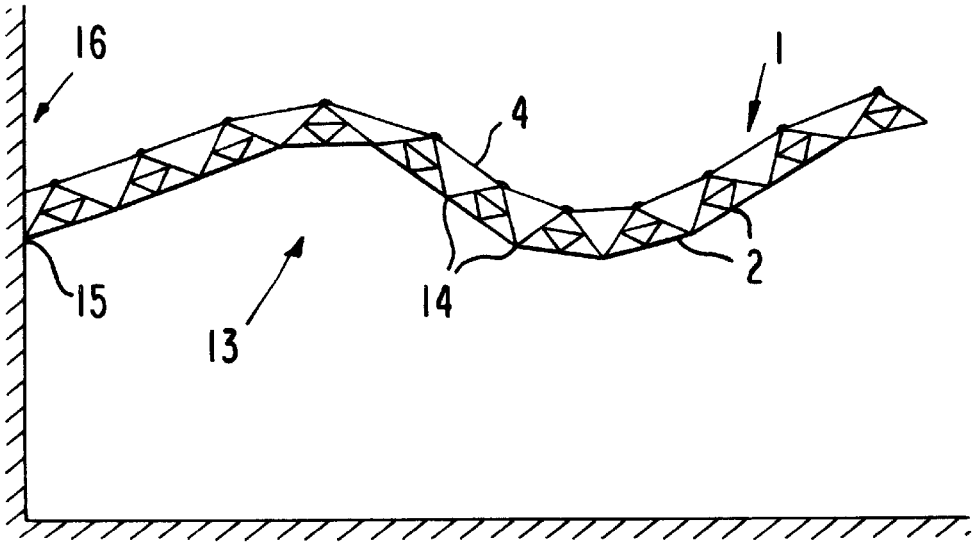
FIG. 2 shows a front view of an articulated modular beam of the present invention, used as an overhang.
Figure 3:
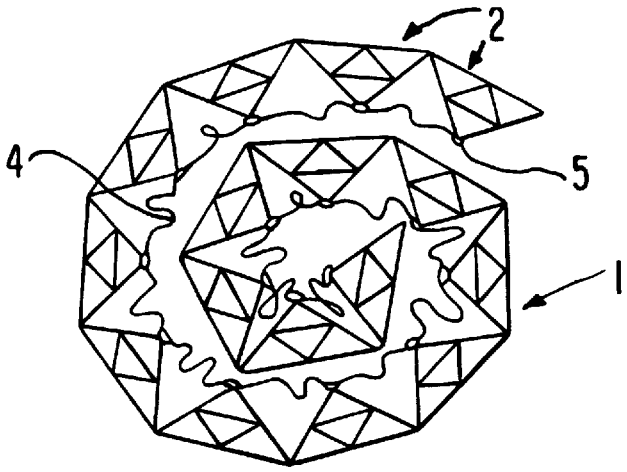
FIG. 3 shows a view of the beam of FIG. 1 rolled into a spiral for storage or transportation.
Figure 5:
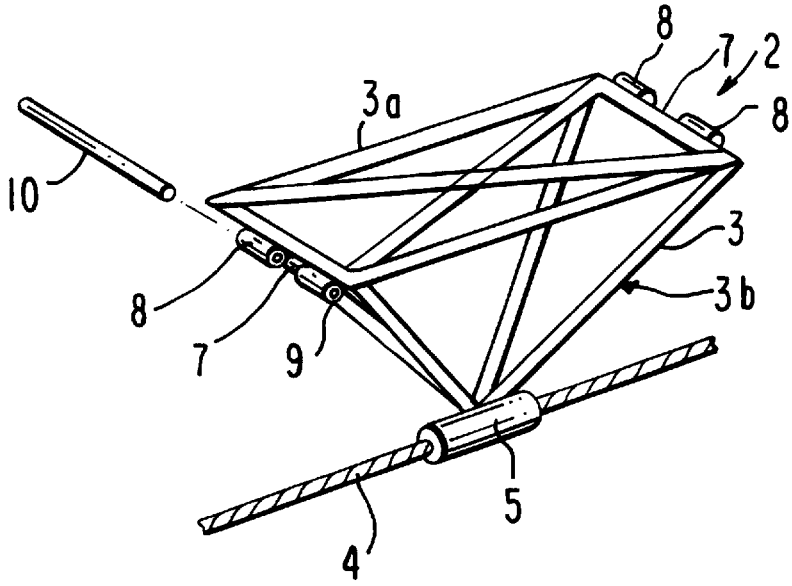
FIG. 5 shows a view in perspective of one of the beam modules of FIG. 4.

As shown in FIGS. 1–3, a beam 1 of the present invention is formed by connecting a plurality of modules 2 so as to be moveable relative to one another. Preferably, the modules are hingedly connected by articulated joints 14, to be described below, in a linear fashion such that each module is rotatable with respect to each adjacently connected module. Each one of the modules 2 has a rigid structural body 3 which can be provided in the form of an open frame or lattice as shown in FIGS. 6A–6C, or can be solid, as shown in FIGS. 7A–7C. Moreover, each module has a planar support surface 3*a*, as shown in FIG. 5, which, together with the similar planar surfaces of the other connected modules, define the continuous length of the beam. These planar support surfaces 3*a*, like the level surfaces of traditional beams, are designed to withstand compression forces. As such, the modules 2 are preferably made from materials most appropriate to resist compression forces such as iron, steel, concrete, etc.

The side of each module opposite the planar support surface 3*a* is narrower in width than the planar support surface 3*a* and defines an apex point 14 located adjacent a tubular member 5. The apex points 14 are coupled to a bendable coupling member 4 at positions determined when the modular beam is constructed, usually at the site it will be used. The bendable coupling member is preferably a metal cable, a chain or rope. By selecting the points at which the coupling member is coupled to each respective apex point, it is possible to determine the maximum distance between adjacent apex points 14 and therefore the relative angular positions of the planar support surfaces 3*a*. For example, in FIG. 1, the distance between the respective apexes of adjacent modules 2-1 and 2-2 is small because the apex points 14 are coupled to the coupling member 4 at nearby points. This causes the adjacent modules 2-1 and 2-2 to bend slightly downwardly with respect to one another. In contrast, the distance between the respective apex points 14 of adjacent modules 2-3 and 2-4 is large because the apex points are coupled to the bendable coupling member 4 at relative distance points. This causes the adjacent modules 2-3 and 2-4 to bend upward with respect to one another.

Figure 4:
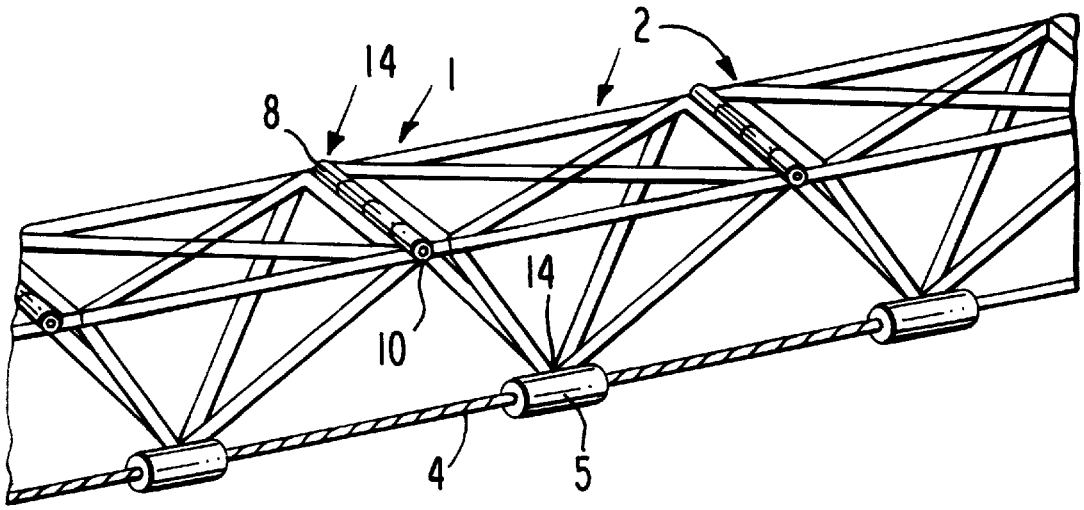
FIG. 4 shows a perspective view of part of the beam of FIG. 1 arranged in its fully extended configuration.

The positions at which the apex points 14 are coupled to the bendable coupling member 4 are adjustable. In the preferred embodiment shown in FIG. 4, the bendable coupling member 4 extends through respective tubular members 5 coupled to each of the apex points 14. Initially the bendable coupling member 4 can be freely moved through the tubular members 5. When the apex point 14 is at the desired location along the coupling member 4, it is fixedly coupled to the associated tubular member 5 by any appropriate means, e.g., a compressive bolt, a clamp or welding. While this is the preferred means for fixing the apex points to the coupling member, any suitable means can be used and the tubular members 5 are not required.

Figure 8:
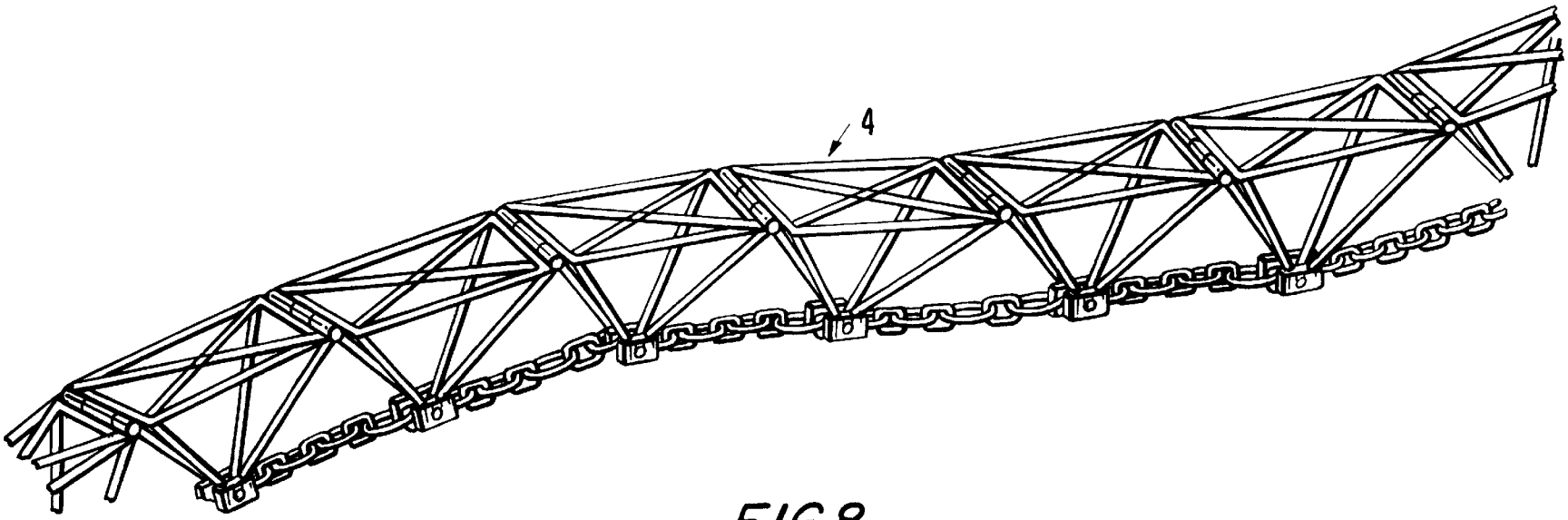
FIG. 8 is an articulated modular beam showing a second embodiment of the present invention.
Figure 9:
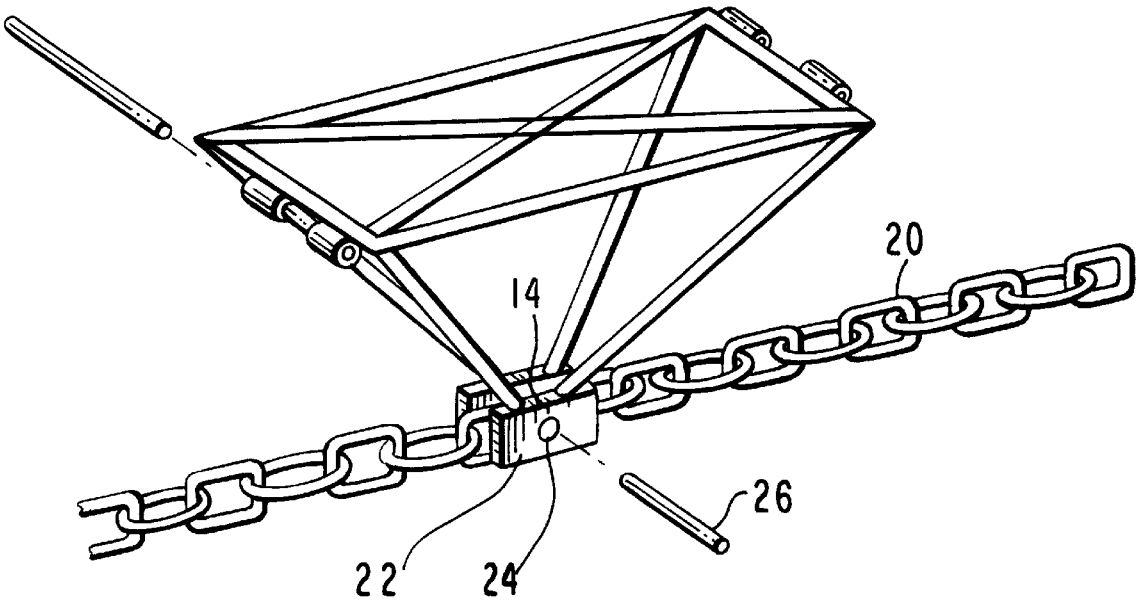
FIG. 9 is a view in perspective of one of the modules of the beam of FIG. 8.
Figure 10:
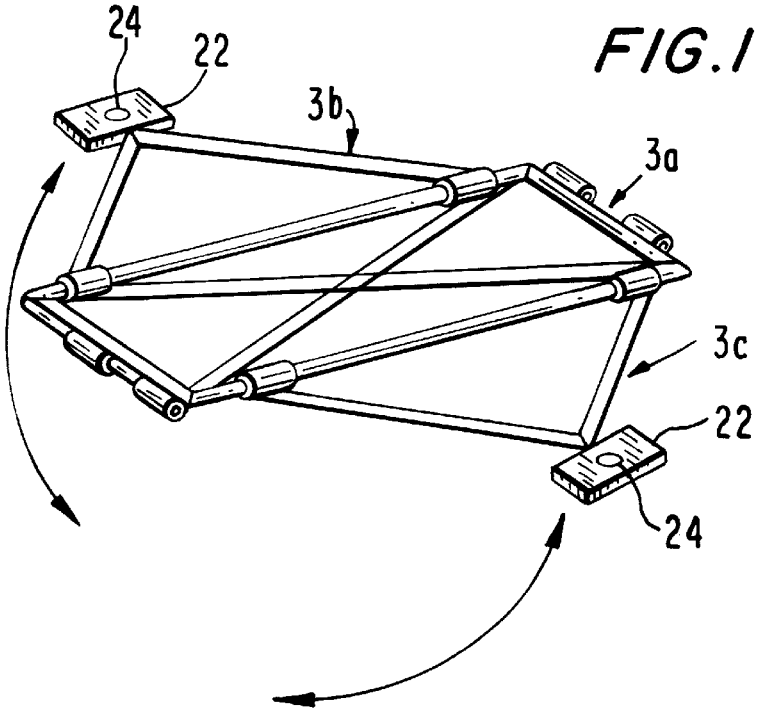
FIG. 10 is a view of the module of FIG. 9 in its collapsed state.

In a second preferred embodiment shown in FIGS. 8–10, the bendable coupling member 4 is comprised of a chain 20 which is engaged with the apex point 14 of each module by a clamp 22 containing an aperture 24 on either side thereof through which a pin 26 is inserted in order to secure the clamp 22 to the chain 20. Clamp 22 and chain 20 are preferably metallic.

As mentioned above, adjacent modules 2 are preferably connected by articulated joints 14 provided between the sides of the adjacent modules to be connected. Preferably, each articulated joint is formed by two sets of interfitting projection elements 6, as shown in FIGS. 7A to 7C, or alternatively 8, as shown in FIGS. 6A to 6C, one set located along one side edge of the planar support surface 3*a* of one module and the mating set located along a side edge of the planar support surface 3*a* of an adjacent module. Each set of interfitting projection elements 6, 8 forms half of an articulated joint 14 which is comprised of at least one interfitting projection element 6, 8 surrounded on either side by recesses 7 or has a recess 7 between two interfitting projection elements 6, 8. As shown in FIGS. 6B and 7B, the shape of each recess corresponds to the shape of an interfitting projection element 6, 8 on an adjacent module 2 which is to be received in the recess 7.

The articulated joints 14 are designed to withstand compression forces which, as such, enable the modules 2 to remain attached to each other after installation because the compression forces to which the beam is subjected are directed against the adjacent modules, thus providing a supporting force to hold the projection elements of the articulated 22 joints in interfitting engagement. Moreover, the shape of the interfitting projection elements 6, 8 forming the articulated joints 14 are designed to permit pivoting or rotational movement between adjacent modules, such as, for example, semi-cylindrical or semi-spherical projection elements along the contacting edges of planar support surfaces as shown in FIGS. 5, 6A and 7A.

The articulated joints 14 can alternatively be secured with a locking element. As seen in FIG. 5, the interfitting projection elements 8 can be formed with a central transversal hole 9 therethrough so that once the projections of two consecutive modules are interfitted, they can be fixed using a shaft bolt 10 which thereby forms the rotation axis of the joint. This feature allows the beams to be assembled either at the use location or to be pre-assembled at a location other than where they will be used, whereupon the beam can then be rolled up, as shown in FIG. 3, for transportation to the installation site.

As best shown in FIG. 6, each module preferably includes three planar sides 3*a*, 3*b* and 3*c* which cooperate to form a triangle in cross-section. In an alternative embodiment, the two sides 3*b* and 3*c* are hingedly coupled to the top side so that the modules can be collapsed as shown in FIG. 10. This makes it easier to package and ship the modules which can then be assembled on site.

Any type of curve can be achieved with the articulated modular beam of the present invention. The size and number of modules included in the beam are determined by the shape and length of the beam required in each case. The flexibility of the present beam allows the beam to be usable in a variety of applications.

For example, FIGS. 1 and 2 illustrate two different applications of the modular articulated beam where each use requires a different beam shape and/or orientation. In FIG. 1, the beam is used to form a portal 11 wherein the beam 1 is supported between two pillars or vertical support structures 12 and is oriented so that the planar support surfaces 3*a* of the modules 2 is facing upward, while the bendable piece 4 and the module portions are arranged to be facing downward. The beam of FIG. 1 can be utilized to support, e.g., a contoured roof or opening.

In FIG. 2, on the other hand, the beam is used to form an overhang 13. In this application, one end 15 of the beam is fixed to a structural base 16 while the other end may be unsupported. Here, the planar support surfaces 3*a* of the modules 2 are turned face down to counteract the compression forces exerted thereat while the bendable piece element 4 is located on the topside of the beam. In this mode, the beam is suitable for use, e.g. when digging or constructing a tunnel, extending the beam piece by piece as work is completed and the tunnel is dug.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An articulated modular beam, comprising:

a plurality of modules, each module including first, second and third points which are fixed in space relative to one another;

each of said modules being coupled to an adjacent module to form a pair of modules, said first point of one module of the pair being hingedly coupled to said second point of the other module of said pair along a respective axis such that said third points of said pair of modules can be moved relative to one another only along a fixed plane which is perpendicular to said axis; and an elongated, bendable coupling member fixedly coupled to each of said third points so as to define a respective maximum distance that each respective pair of third points can be moved apart from one another.

2. The beam of claim 1, wherein one end of said coupling member is anchored to an anchor point so that it cannot be moved.

3. The beam of claim 1, wherein said coupling member is a linked chain.

4. The beam of claim 3, wherein said linked chain is fixedly coupled to each of said third points by a respective pin.

5. The beam of claim 1, wherein said coupling member is a rope.

6. The beam of claim 1, wherein said coupling member is a metal cable.

7. The beam of claim 1, wherein, for each of said modules, a tubular structure extends through said third point and said coupling member passes through said tubular structure.

8. The beam of claim 1, wherein each of said modules is pyramid-like in shape having an apex coupled to a generally rectangular base.

9. The beam of claim 8, wherein, for each of said modules, said first and second points are located at respective sides of said generally rectangular base and said third point is located at said apex.

10. The beam of claim 1, wherein each of said modules is defined by a plurality of straight rods coupled to one another to form a pyramid-like shape.

11. The beam of claim 10, wherein each of said pyramid-like shapes has an apex and a generally rectangular base.

12. The beam of claim 11, wherein for each of said modules, said first and second points are located at respective sides of said generally rectangular base and said third point is located at said apex.

13. The beam of claim 1, wherein each of said modules includes a planar support section having first and second opposite ends, said first and second points being located at said first and second ends, respectively.

14. The beam of claim 13, wherein for each said pair of modules, said first end of one of said planar support surfaces lies adjacent said second end of the other of said planar support surfaces, said axis lying between said first and second ends of said planar support surfaces, whereby said first and second planar support surfaces, and along with them said third points, can be rotated relative to said axis.

15. The beam of claim 14, wherein, for each of said modules, said first, second and third points of each said module form a respective triangle in space.

16. The beam of claim 1, wherein each of said modules has at least first, second and third planar sides which together form a triangle in cross-section.

17. The beam of claim 16, wherein each of said first, second and third planar sides are defined by respective sets of open lattice work.

18. The beam of claim 17, wherein each of said first, second and third planar sides are defined by respective sets of metal bars.

19. The beam of claim 16, wherein said first and second planar sides of each said module are hingedly coupled to said third planar side of said module.

20. A flexible beam, comprising:

first and second modules forming a pair of adjacent modules, each module including first, second and third points which are fixed in space relative to one another to form a triangle;

said first point of one module of said pair being hingedly coupled to said second point of the other module of said pair such that said third points of said pair of modules can be moved relative to one another by the rotation of said modules with respect to one another; and an elongated, bendable coupling member fixedly coupled to each of said third points so as to define a respective maximum distance that said third points can be moved apart from one another.

21. A kit comprising:

a plurality of modules, each module including first, second and third points which are fixed in space relative to one another, each of said modules having integral hinge components which extend through said first and second points, respectively;

a plurality of further hinge components for cooperating with said integral hinge components to permit respective pairs of modules to be hingedly coupled to one another along a respective axis which is unique to each such pair wherein said third points of said pair of modules can be moved relative to one another only along a fixed plane which is perpendicular to said axis; and an elongated, bendable coupling member; and a plurality of fixing members for fixing each third point to a respective location along said coupling member.

22. The kit of claim 21, wherein said coupling member is a linked chain.

23. The kit of claim 21, wherein said fixing members are pins.

24. The kit of claim 21, wherein said coupling member is a rope.

25. The kit of claim 21, wherein said coupling member is a metal cable.

26. The kit of claim 21, wherein, for each of said modules, a tubular structure extends through said third point and said coupling member is adapted to pass through said tubular structure.

27. The kit of claim 21, wherein each of said modules is pyramid-like in shape having an apex coupled to a generally rectangular base.

28. The kit of claim 27, wherein, for each of said modules, said first and second points are located at respective sides of said generally rectangular base and said third point is located at said apex.

29. The kit of claim 21, wherein each of said modules is defined by a plurality of straight rods coupled to one another to form a pyramid-like shape.

30. The kit of claim 29, wherein each of said pyramid-like shapes has an apex and a generally rectangular base.

31. The kit of claim 30, wherein, for each of said modules, said first and second points are located at respective sides of said generally rectangular base and said third point is located at said apex.

32. The kit of claim 21, wherein each of said modules includes a planar support section having first and second opposite ends, said first and second points being located at said first and second ends, respectively.

33. The kit of claim 32, wherein, for each of said modules, said first, second and third points of each said module form a respective triangle in space.

34. The kit of claim 21, wherein each of said modules has at least first, second and third planar sides which together form a triangle in cross-section.

35. The kit of claim 34, wherein each of said first, second and third planar sides are defined by respective sets of open lattice work.

36. The kit of claim 35, wherein each of said first, second and third planar sides are defined by respective sets of metal bars.

37. The kit of claim 34, wherein said first and second planar sides of each said module are hingedly coupled to said third planar side of said module and said kit further includes means for coupling said first and second planar sides together to form said triangular cross-section.

38. The beam of claim 1, wherein at least two of said respective maximum distances are different from one another.

39. The beam of claim 20, wherein at least two of said respective maximum distances are different from one another.

* * * * *